US005256840A

United States Patent [19]

Pirhadi

[11] Patent Number: 5,256,840

[45] Date of Patent: Oct. 26, 1993

[54] HOLDING DEVICE FOR PISTON POSITION DETECTOR

[75] Inventor: Ebrahim Pirhadi, Enskede, Sweden

[73] Assignee: AB Mecman, Stockholm, Sweden

[21] Appl. No.: 852,221

[22] PCT Filed: Nov. 28, 1990

[86] PCT No.: PCT/SE90/00787

§ 371 Date: Jun. 2, 1992

§ 102(e) Date: Jun. 2, 1992

[87] PCT Pub. No.: WO91/10070

PCT Pub. Date: Jul. 11, 1991

[30] Foreign Application Priority Data

Dec. 22, 1989 [SE] Sweden ..... 8904356

[51] Int. Cl.[5] ..... H01H 35/38

[52] U.S. Cl. ..... 200/82 R; 73/745; 91/275; 92/5 L; 248/500; 200/82 E

[58] Field of Search ..... 73/745; 307/118; 340/611, 626; 335/205; 91/275; 92/5 L; 248/154, 214, 500, 506; 200/293, 294, 47, 82 R, 82 E, 82 C

[56] References Cited

U.S. PATENT DOCUMENTS 4,071,725 1/1978 Smith ..... 200/82 E
4,086,456 4/1978 Bone ..... 200/303
4,230,023 10/1980 Ward .
4,594,487 6/1986 Grassl ..... 200/82 E
4,752,657 6/1988 Kane ..... 200/82 R
4,800,241 1/1989 McNamara ..... 200/82 E
4,898,079 2/1990 Combette ..... 92/5 R

FOREIGN PATENT DOCUMENTS 3516346 4/1986 Fed. Rep. of Germany .
2195711 4/1988 United Kingdom .

*Primary Examiner*—Gerald P. Tolin
*Attorney, Agent, or Firm*—Townsend and Townsend Khourie and Crew

[57] ABSTRACT

Holding device for a piston position detector, contained in a casing and being displaceably mounted on the outside of a fluid pressure cylinder. The holding device consists essentially of a U-shaped yoke being displaceable along two mutually parallel guides and being lockable in a desired axial position. The yoke is locked by means of a first fastening screw, whereas the casing is insertable between the shanks of the yoke and is lockable in inserted position by means of a second fastening screw. The casing is protected by the yoke and is detachable from the latter, also when the yoke is located to the guides.

13 Claims, 1 Drawing Sheet 1
2
3
4
4a
4b
5
6
6a
6b
6c
7
7a
7b
8
8a
8b
9
10
10a
11
12
13
14
14'
15
15'
15a
16
16'

HOLDING DEVICE FOR PISTON POSITION DETECTOR

The invention concerns a holding device, which is displaceably mounted on the outside of a fluid pressure cylinder, for a piston position detector, the holder is displaceable and lockable at any desired position on a longitudinal guide on the outside of the cylinder tube.

Such a holding device is previously known from DE-C-3 516 346 (Daimler-Benz AG). This previously known device comprises a bracket like holder with two hook shaped clamping elements, which are jointly displaceable along a tension rod associated with the fluid pressure cylinder. One of the clamping elements is provided with a radially extending holding plate. A casing, incorporating a piston position detector, is detachably mounted to the holding plate by means of two screws. The other clamping element, which is pivotable relative to the first clamping element, is provided, on the one hand, with a fastening screw for application against the tension rod and, on the other hand, with a clamping screw effective between the clamping elements. Upon tightening the clamping screw the two clamping elements pivot in opposite directions, so that the casing and a protruding tongue element of the second clamping element are pressed against the exterior of the cylinder tube under clamping action.

On the basis of the above mentioned prior art and other similar arrangements (U.S. Pat. No. 4,230,023, EP-A-0 125 992 and EP-A-0 309 304) the present invention achieves a simple and reliable holding device, which includes the least possible number of screws or similar fastening elements;

enables simple detachment of the casing of the piston position detector also when the holder is positioned and fastened in the desired position; and protects the casing (and thereby the piston position detector) against external influences.

A further object is to assure a fixation without play of the casing to the holding device with reproducable precision, so that the casing, and thereby the piston position detector, is placed in exactly the same position after detachment and remounting, yet another object is to facilitate a protected placing of a signal cable which is connected to the piston position detector, so that the latter is also protected against external influences.

The above stated objects of the invention are achieved with a holder having a U-shaped yoke, into which the casing is at least partly insertable, whereby the casing together with a piston position detector contained therein is protected by the surrounding yoke. Further, only two fastening means are needed. The first fastening means is used for the fixation of the two shank ends of the yoke to the mutually parallel guides. The second fastening means is used for the fixation of the casing in the inserted position in the yoke. It is essential that the casing can be detached from and remounted into the yoke, also when the latter is held in a fixed position by the first fastening means.

According to a preferred embodiment of the invention, the second fastening means includes a (second) fastening screw, which upon insertion of the casing between the shanks of the yoke is inserted transversally between the shanks, and which by means of an elastic sleeve (which is compressed axially and thereby expanded radially) engages between two stop means arranged at a longitudinal distance from each other on the casing.

The invention will be explained in greater detail below with reference to the accompanying drawing.

Figures 1, 2, 3, 4:
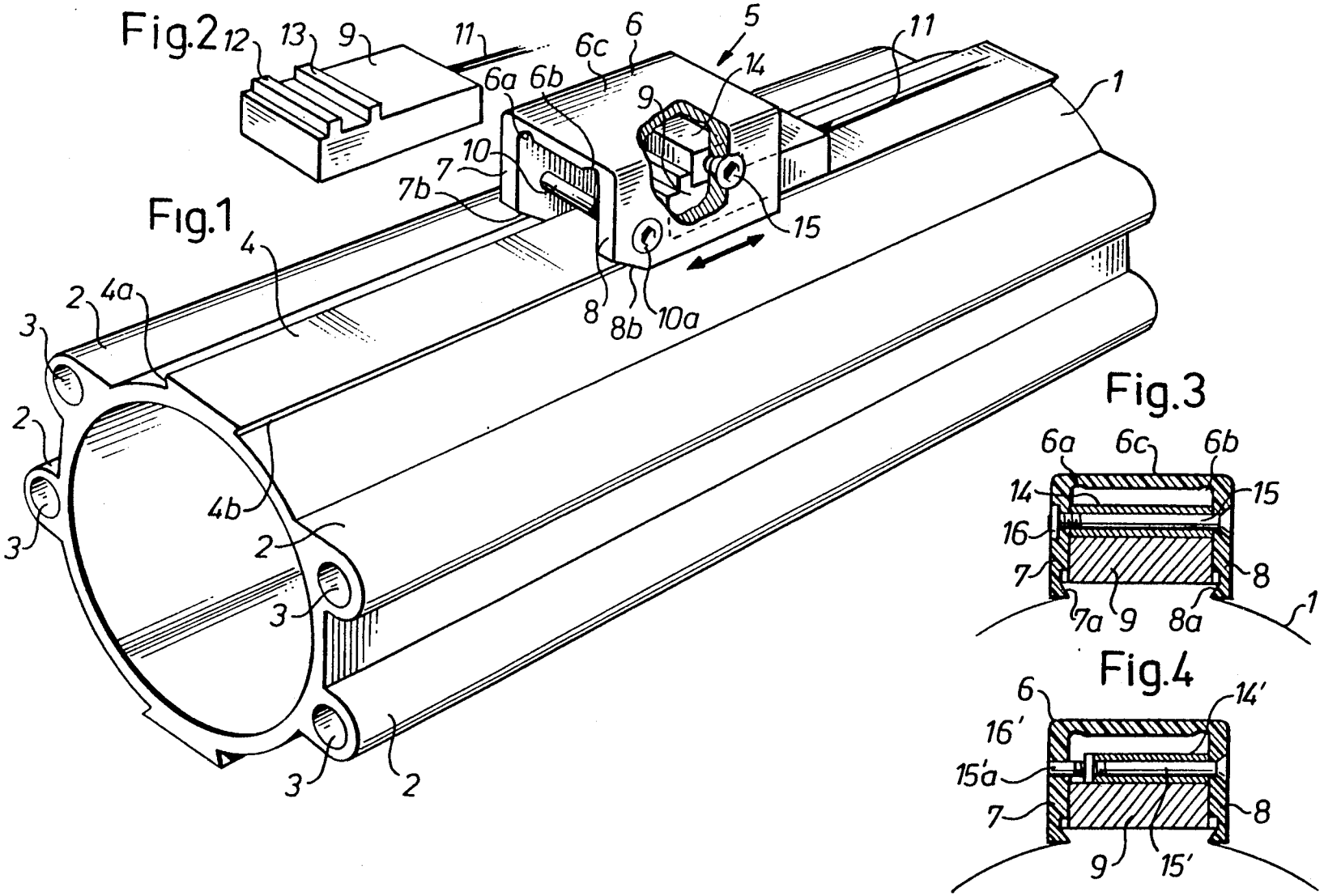
FIG. 1 is a perspective view of a cylinder tube (the end plates and the piston of the fluid pressure cylinder are not shown) with a holding device according to the invention displaceably arranged on the outside thereof; the holding device being partly cut away to show a casing for a piston position detector inserted therein.
FIG. 2 is a perspective view of the piston position detector casing.
FIG. 3 is a cross-section through the holding device in a vertical plane and through a fastening screw used for fastening said casing.
FIG. 4 is a cross-section of FIG. 3.

In FIG. 1 is shown a cylinder tube 1 of a fluid pressure cylinder, where the cylinder end plates and piston are not shown. The cylinder tube 1 is preferably manufactured from a light metal alloy and has. The cylinder tube also has longitudinal beads 2 with through holes 3 therein for fastening screws (not shown) for the end plates and, on the other hand, a dovetail-shaped longitudinal bead 4, which at its longitudinal edges form undercut, mutually parallel guide slots 4*a*, 4*b* for a holding device 5 according to the invention displaceable along the cylinder tube.

The holding device 5 for a piston position detector includes a U-shaped yoke 6, the shanks 7 and 8 of which at their ends are formed with inwardly projecting gripping edges 7*a*, 8*a*, which engage the guide slots 4*a*, 4*b*. The yoke 6 may be made of metal but is preferably produced out of a rigid plastic material rendering the yoke a certain dimensional flexibility as well as good sliding properties relative to the guide slots 4*a*, 4*b*. The dimensional flexibility, which is also increased by the longitudinal weakenings 6*a*, 6*b* in the web portion, or top, 6*c* of the yoke adjacent to the respective shank, is utilized for the detachable fastening of a casing 9 incorporating a piston position detector at the inside of the yoke 6 between its shanks 7, 8. At one end, as seen lengthwise, the shanks are provided with bevels or recesses 7*b*, 8*b* in the respective corner area to enable the displacement of the yoke all the way to the associated cylinder end plate. The yoke 6, serving as holder, is thus displacable along the whole length of the cylinder tube 1 (for the positioning close to the second end plate, the yoke can be snapped out of the guide slots 4*a*, 4*b* and turned 180°, so that the bevelled corner portions 7*b*, 8*b* abut said second plate) and may be positioned and fixed in a desired position by means of a transverse fastening screw 10. When the transverse fastening screw 10 is tightened presses the shanks 7, 8 of the yoke are drawn towards each other in the area of the fastening screw 10, i.e. near one end of the yoke 6 close to the gripping edges 7*a*, 8*a*, so that the latter will frictionally engage the guide slots 4*a*, 4*b* and thereby fix the yoke 6 in a well-defined position. The head 10*a* of the fastening screw 10 is countersunk in a corresponding conical recess in the shank 8, while the threaded end portion (not visible in the figures) is in threaded engagement with a nut, which is non-rotatably guided in a recess at the outside of the opposite shank 7 (in the same way as the fastening screw shown in FIG. 3).

The casing 9, which contains a piston position detector (not shown) connected to a signal cable 11, is essentially box-shaped and dimensioned to fit into the yoke with its mutually parallel side surfaces between the shanks 7, 8. On the upper side of the casing is provided two transverse ridges 12, 13 serving as stop means forming therebetween a rectangular channel. Before inserting the casing 9 into the position shown in FIG. 1; a sleeve of a relatively stiff elastic material is placed in the C channel between the ridges 12, 13. Upon placing the casing 9 in position, a second transverse fastening screw 15 can be inserted through a hole in the shank 8 and through the central hole of the sleeve 14 to an opposite hole in the shank 7, where a nut 16 is non-rotatably arranged in a recess in the outside of the shank 7 for threaded engagement with the fastening screw 15. When the fastening screw 15 is tightened, the shanks 7, 8 are pressed together, so that they will be mutually parallel along the full length of the yoke 6 (by tightening of only the fastening screw 10 the shanks will diverge somewhat in the direction towards the rear opening through which the casing 9 is inserted). At the same time, the engagement of the gripping edges 7*a*, 8*a* to the guide slots 4*a*, 4*b* will increase, and the elastic sleeve will be compressed axially, so that it is somewhat deformed radially, thereby eliminating the play against the associated fastening screw 15. Thus, the casing 9 is fixed effectively without play in the inserted position inside the yoke 6.

Instead of placing the nut 16 in a recess in the shank 7, the nut 16′ (see FIG. 4) may be non-rotatably arranged in the rectangular slot between the ridges 12, 13, so that the nut 16′ engages directly with the end of the sleeve 14′ (and not via the shank wall). Hereby, a great deformation of the sleeve 14′ is assured. The free end portion 15′*a* of the fastening screw 15′, formed as a guiding pin, is guided with a close fit in a corresponding circular hole in the shank 7. To achieve the best possible fastening action, the nut 16′ is of square section, so that it will fit well into the rectangular slot between the ridges 12 and 13.

It is obvious that the second fastening screw 15 or 15′ can be loosened easily, so that the casing 9 can be withdrawn from the yoke 6 while the yoke is locked in a well-defined position by means of the first fastening screw 10.

If desired, the signal cable 11 may be protected by a covering strip (not shown), which is cut into a desired length (corresponding to the distance between the rear end of the casing 9 and the rear end plate) and snapped onto the dovetailed bead 4. At the same time, the casing 9, with the piston position detector contained therein, will be protected by the entirely or partly surrounding yoke 6.

The second fastening screw 15 may cooperate with the casing 9 in another way, e.g. without the intermediary of the sleeve 14 by direct cooperation with a transverse recess or hole in the casing. Alternatively, the ridges 12, 13 may be replaced by a number of upward projections distributed transversally in a suitable manner for the forming of stop means on both sides of the second fastening screw 15 (with or without a sleeve) or by fastening means formed in some other way.

Further, the mutually parallel guide slots 4*a*, 4*b* may be formed differently and do not have to be made in one piece with the cylinder tube. They may, e.g., be formed in a separate longitudinal rail or consist of two separate guide strips. The yoke 6 may likewise be modified, e.g. consisting of two parts with a longitudinal joint in the web portion. It should, however, be of sufficient length to contain a substantial part of the casing 9. Also, the latter may have a different external shape provided that it is entirely or partly insertable between the shanks of the yoke and is lockable in a well-defined position by means of the second fastening means. These second means may, e.g., consist of a fence bar, arresting pins or the like, being movable into locking engagement with the casing from the web portion 6*c* of the yoke.

I claim:

1. A device for securing a piston position detector to a cylinder tube having two parallel longitudinal guides rigidly attached to the outside of the cylinder tube, and the piston position detector being disposed in a casing, the device comprising:

an essentially U-shaped yoke having two shanks with shank ends adapted to be positioned against the two mutually parallel guides, the yoke being sized so that the casing of the piston position detector is at least partly insertable between the two shanks;

first means for fastening the yoke to the two guides, the first fastening means bringing the shank ends towards each other and into frictional contact with the guides;

second means for fastening the piston position detector at least partly between the two shanks in an inserted position, said second fastening means including a fastening screw extending between the shanks in the inserted position, said fastening screw locking the casing against displacement in the longitudinal direction of the cylinder when tightened; and a sleeve made of an elastic material, the sleeve being inserted between the shanks and having a through hole which contains the fastening screw, the sleeve being caused to expand radially upon tightening of the fastening screw for positioning the casing without play.

2. The holding device according to claim 1, wherein the fastening screw brings the shanks closer to one another and thereby expands the sleeve radially when the inner sides of the shanks compress the sleeve axially.

3. The holding device according to claim 1, wherein the fastening screw acts between one of the shanks and a nut which is non-rotatably guided by the casing.

4. The holding device according to claim 3, wherein a free end of the fastening screw forms a guiding pin, being guided in a hole in the other shank essentially without play.

5. A device securing a piston position detector to a cylinder tube having two parallel longitudinal dovetail slots formed on the outside of the cylinder tube, and the piston position detector being disposed in a casing, the device comprising:

an essentially U-shaped yoke having two parallel shanks ending at shank ends, the shank ends being adapted to be positioned against the two mutually parallel guides, the yoke being sized so that the casing of the piston position detector is at least partly insertable between the two shanks, the yoke being made of a relatively rigid but flexible material;

first means for fastening the yoke to the two guides, the first fastening means extending between the shanks and being adapted to pull the shanks towards one another, so as to effect a frictional grip between the shank ends and the guides with a force transverse to the shanks; and second means for fastening the casing at least partially between the two shanks; and the shank ends being provided with gripping edges engaging said dovetail slots.

6. A device securing a piston position detector to a cylinder tube comprising:

the cylinder tube having two parallel longitudinal guides rigidly attached;

an essentially U-shaped yoke having two parallel shanks ending at shank ends, each shank end being positioned against and engaging one of the longitudinal guides;

a piston position detector at least partly inserted between the shanks;

first means fastening the shank ends to the longitudinal guides, the first fastening means extending between the shank ends and being adapted to pull the shanks towards one another, so as to effect a frictional grip between the shank ends and the guides with a force transverse to the shanks; and second means fastening the piston position detector between the two shanks.

7. A device for securing a piston position detector to a cylinder tube having two parallel longitudinal guides rigidly attached to the outside of the cylinder tube, and the piston position detector being disposed in a casing, the device comprising:

an essentially U-shaped yoke having two parallel shanks ending at shank ends, the shank ends being adapted to be positioned against the two mutually parallel guides, the yoke being sized so that the casing of the piston position detector is at least partly insertable between the two shanks, the yoke being made of a relatively rigid but flexible material;

first means for fastening the yoke to the two guides, the first fastening means extending between the shanks and being adapted to pull the shanks towards one another, so as to effect a frictional grip between the shank ends and the guides with a force transverse to the shanks; and second means for fastening the casing at least partially between the two shanks.

8. The holding device according to claim 7, wherein said first fastening means comprises a first fastening screw having a first end secured to one of the shank ends and a second end secured to the other shank end.

9. The holding device according to claim 8, wherein the first fastening screw is positioned at one longitudinal end of the yoke, and said casing is at least partially insertable into the other end of the yoke.

10. The holding device according to claim 9, wherein the first fastening screw is positioned near the shank ends.

11. A device for securing a piston position detector to a cylinder tube having two parallel longitudinal guides rigidly attached to the outside of the cylinder tube, and the piston position detector being disposed in a casing, the device comprising:

an essentially U-shaped yoke having two parallel shanks ending at shank ends, the shank ends being adapted to be positioned against the two mutually parallel guides, the yoke being sized so that the casing of the piston position detector is at least partly insertable between the two shanks, the yoke being made of a relatively rigid but flexible material;

first means for fastening the yoke to the two guides, the first fastening means extending between the shanks and being adapted to pull the shanks towards one another, so as to effect a frictional grip between the shank ends and the guides with a force transverse to the shanks; and second means for fastening the casing at least partially between the two shanks; and said second fastening means comprising a second fastening screw extending between the shanks in an inserted position, said second fastening screw securing the casing against displacement in the longitudinal direction of the cylinder when tightened.

12. The holding device according to claim 11, wherein the casing includes two stop means arranged at a distance from one another, the second fastening screw extending between the two stop means in the inserted position.

13. The holding device according to claim 12, wherein said stop means comprises ridges extending transverse to the shanks.

* * * * *